United States Patent [19]

Kozinski

[11] 4,269,056

[45] May 26, 1981

[54] CONDUIT BENDER CONSTRUCTION

[76] Inventor: Richard R. Kozinski, 2205 Dunkeith Dr., NW., Canton, Ohio 44708

[21] Appl. No.: 43,094

[22] Filed: May 29, 1979

[51] Int. Cl.[3] ..... B21D 7/02

[52] U.S. Cl. ..... 72/459

[58] Field of Search ..... 72/459, 458, 457, 298, 72/36, 34, 32

[56] References Cited

U.S. PATENT DOCUMENTS

| | | | |
|---|---|---|---|
| 2,233,292 | 2/1941 | Lewin | 72/459 |
| 2,381,064 | 8/1945 | Lewin | 72/459 |
| 2,584,537 | 2/1952 | Benfield | 72/459 |
| 2,817,986 | 12/1957 | Benfield | 72/459 |
| 2,906,149 | 9/1959 | Benfield | 72/459 |
| 3,063,314 | 11/1962 | Benfield | 72/459 |

*Primary Examiner*—Charlie T. Moon
*Assistant Examiner*—Gene P. Crosby
*Attorney, Agent, or Firm*—Frease & Bishop

[57] ABSTRACT

An improved conduit bender of the type having a curved rocker base portion formed by a pair of laterally spaced, arcuate-shaped side walls which define longitudinally extending conduit-receiving groove means therebetween. A hook formation is formed at one end of the base portion and a treadle member is formed at the opposite end. The improvement includes the formation of two pairs of curved surface sections on the inner surfaces of the side walls which form a pair of vertically spaced overlapping conduit-receiving grooves therebetween to enable the improved bender to be used for forming bends in the four types of electrical conduits presently used in the building industry. The inner groove is used to bend the single type of thin-wall conduit (EMT) and the outer groove is used to bend the three types of rigid or heavy-wall conduits. The starting and ending points of the arcuate bending surfaces of the two grooves are offset 15° longitudinally with respect to each other to provide full contact between the conduits and the bending surfaces of their respective grooves. The bending surface of the outer groove for the three heavy-wall conduits starts 15° earlier and stops 15° earlier than the bending surface of the single thin-wall conduit groove with respect to the hook formation end.

8 Claims, 14 Drawing Figures

CONDUIT BENDER CONSTRUCTION

BACKGROUND OF THE INVENTION

1. Field of the Invention

The invention relates to benders for bending pipe, conduit, tubing, and the like at the point of installation. More particularly, the invention relates to a conduit bender having a pair of vertically spaced overlapping conduit-receiving grooves formed in the rocker or base portion thereof, enabling the four types of electrical conduit presently being used in the industry to be bent with the single bender of the invention.

2. Description of the Prior Art

There are numerous types and styles of portable conduit benders which are used by electricians for bending conduit at a job site to form radii of predetermined angles therein prior to installation of the conduit in a new or existing building, primarily for use as a duct for housing electrical wiring. One of the most common types of conduit benders used by electricians today has an arcuate-shaped base or rocker portion with a longitudinally extending conduit-receiving groove formed therein, with a conduit-engaging hook portion formed at one end and a foot treadle portion at the opposite end. An intervening handle is attached to the bender for applying the bending pressure to a section of conduit in combination with pressure applied to the treadle portion. Examples of these types of benders are shown in U.S. Pat. Nos. 2,584,537, 2,817,986 and 2,906,149. These benders provide a satisfactory and efficient device for bending conduit and the like on a job site and are used extensively in the building industry.

There are presently in use today four types of conduits used for duct work in electrical installations to provide a protective housing for the electrical wires. These types are referred to as EMT (electrical metallic tubing) which is a thin-wall tubing or conduit; IMC-Type 1 (intermediate metallic conduit); IMC-Type 2; and Rigid. These four types of tubing come in the various nominal size ratings, such as ½", ¾", 1", and 1¼".

A different bender is required for bending the EMT thin-wall conduit for each nominal size rating than the bender which is required for the other three types of conduit for the same nominal size conduit. For example, the ½" EMT conduit has a 0.706" O.D., requiring a particular size bender, and the ½" IMC-Type 2 and ½" Rigid conduits have O.D.'s of 0.840", and the ½" IMC-Type 1 has an O.D. of 0.816". These latter three types of ½" conduit all can be bent with a single bender which is a different bender than the bender required for the ½" EMT conduit. Throughout the specification the EMT conduit will be referred to as "thin wall" and the other three types are referred to as "heavy-wall" conduits.

Therefore, an electrician is required to have two conduit benders for each nominal size conduit, increasing the cost of his tools and the additional labor required for transporting the tools to and from a job site, etc.

Accordingly, the need has existed for a single conduit bender which will satisfactorily bend the four general types of conduit in each nominal size rating, eliminating a separate bender for the thin-wall and for heavy-wall conduits. No known bender construction of which I am aware accomplishes these results.

SUMMARY OF THE INVENTION

Objectives of the invention include providing an improved conduit bender construction which is provided with a pair of overlapping conduit-receiving grooves which are formed in the rocker or curved base portion which enable the four types of conduits in a nominal size rating to be bent by the single bender, eliminating the heretofore required two different benders, one for the thin-wall conduit and a second bender for the three heavy-wall conduits of a particular size rating; providing such a bender construction which is very similar in use and construction to the benders presently used in the industry, thereby eliminating a complete redesigning of the existing production molds and manufacturing equipment, and eliminating the need for retraining or teaching of electricians in its use; providing such a bender construction which can be used with existing angle markings provided on the rocker member to permit angles other than the usual 90° bend to be formed for both thin and heavy-wall conduits; providing such a bender construction in which the heavy-wall conduit bending surface starts and stops 15° earlier in forming a full 90° bend than the thin-wall conduit bender surface to provide full contact between the conduit walls and bending surface at the start of the bend to avoid collapse of the conduit wall; providing such a bender construction which will produce all Electrical Code bends in the four types of nominal size ratings thereof without excess flattening or kinking; and providing such a bender construction which is of an extremely simple, efficient, rugged and durable construction, which reduces labor and tool costs, which satisfies difficulties existing in the art, and obtains new results in the art.

These objectives and advantages are obtained by the improved conduit bender construction of the invention, the general nature of which may be stated as including a body portion, a curved base portion formed on the body portion with said curved base portion having a pair of spaced arcuate-shaped side walls having inside surfaces defining longitudinally extending conduit-receiving groove means therebetween, a conduit-engaging hook portion at one end of the curved base portion and a treadle member at the other end of said base portion, the side wall inside surfaces having surface sections forming inner and outer longitudinally extending conduit-receiving grooves, with said inner groove having a smaller radius of curvature in cross section than said outer groove; the longitudinally extending arcuate bending lengths of the inner and outer grooves being approximately 100° with said grooves being in concurrent relationship with respect to each other for at least 70° of their individual 100° bending arcs; and with the bending arc of the outer groove starting approximately 15° before the start of the bending arc of the inner groove with respect to the hook portion end of the curved base portion.

BRIEF DESCRIPTION OF THE DRAWINGS

A preferred embodiment of the invention—illustrative of the best mode in which applicant has contemplated applying the principles—is set forth in the following description and shown in the accompanying drawings, and is particularly and distinctly pointed out and set forth in the appended claims.

Similar numerals refer to similar parts throughout the drawings.

DESCRIPTION OF THE PREFERRED EMBODIMENT

Figure 1:
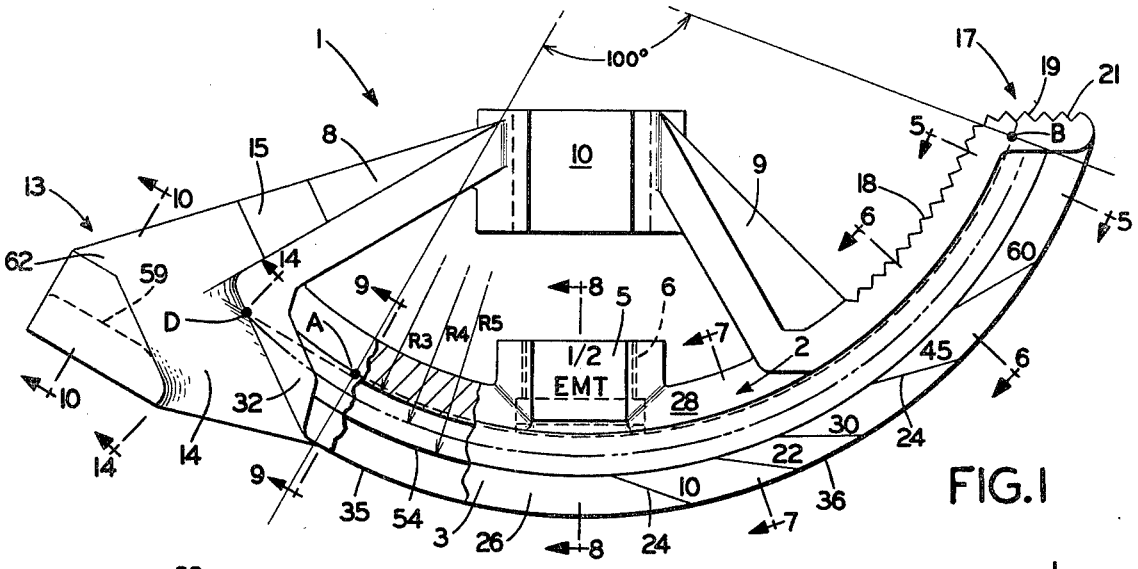
FIG. 1 is a side elevational view of the improved conduit bender construction.

The improved conduit bender construction is shown particularly in FIGS. 1–4 and is indicated generally at 1. The term "conduit" as used throughout the following description and claims is understood to mean pipes, tubing, rods or similar members and, primarily, to the four types of conduits presently used in electrical wiring installations.

Bender 1 is of the general type shown in U.S. Pat. Nos. 2,584,537 and 2,817,986 and preferably is formed of a one-piece metal casting. Bender 1 includes a body portion indicated generally at 2 having a rocker or curved base portion 3. The inner central portion of curved base 3 is shaped to form a socket 5 having a hexagonal outer configuration and an internally threaded bore 6 for receiving the threaded end of a usual bender handle (not shown). Extending upwardly and in converging relationship from curved base 3 is a pair of upright members 8 and 9 which terminate at their upper ends in a handle-supporting sleeve 10. Sleeve 10 also has a hexagonal outer configuration similar to socket 5 and is formed with a smooth inner bore 11 for slidably receiving the operating handle therein.

Figure 2:
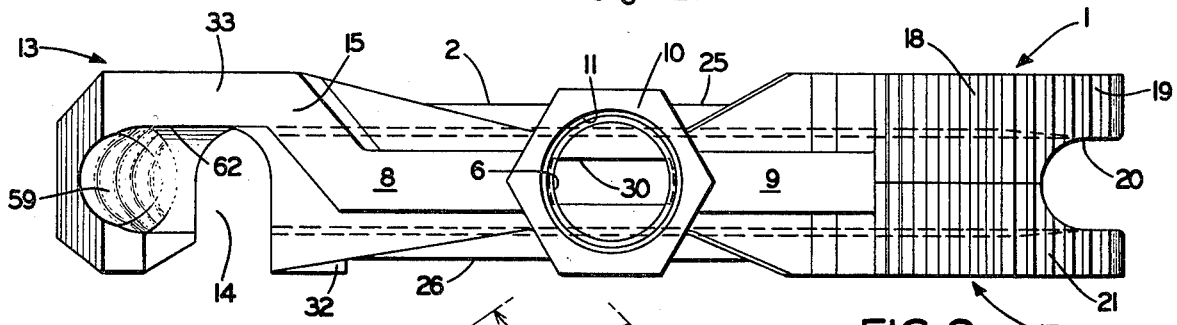
FIG. 2 is a top plan view of the improved bender construction shown in FIG. 1.

With reference to FIGS. 1 and 2, the left-hand end of curved base 3 terminates in a usual U-shaped hook formation 13, referred to in the trade as "the hook" of the bender, and which is provided with a sloped side opening 14 for insertion of a section of conduit therethrough in the usual manner. Hook formation 13 is formed integrally with one side of the base portion and is connected to upright member 8 by a reinforcing rib 15.

The end of base portion 3 opposite of hook 13 extends in a curved direction outwardly beyond upright member 9 and forms a usual bending foot treadle, indicated generally at 17. Treadle 17 comprises a curved portion 18 and a top, horizontally extending portion 19. Treadle portion 19 is formed with a U-shaped opening 20 (FIG. 2) through which a conduit extends upon the formation of a full 90° bend. The top surfaces of treadle portions 18 and 19 are provided with a plurality of laterally extending serrations 21. Foot treadle 17 is adapted to be engaged by the foot of an electrician to apply bending pressure to a section of conduit in cooperation with an additional bending force exerted thereon by a handle inserted through supporting sleeve 10 and threadably engaged in lower socket 5.

Figure 3:
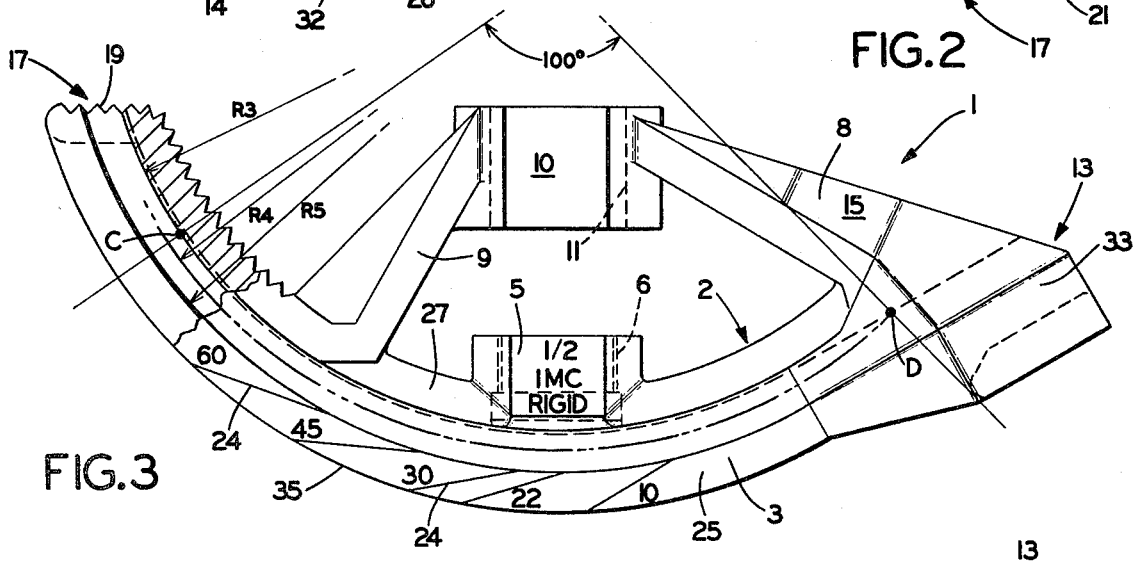
FIG. 3 is a side elevational view of the improved bender construction looking in the opposite direction from the side view shown in FIG. 1.
Figure 4:
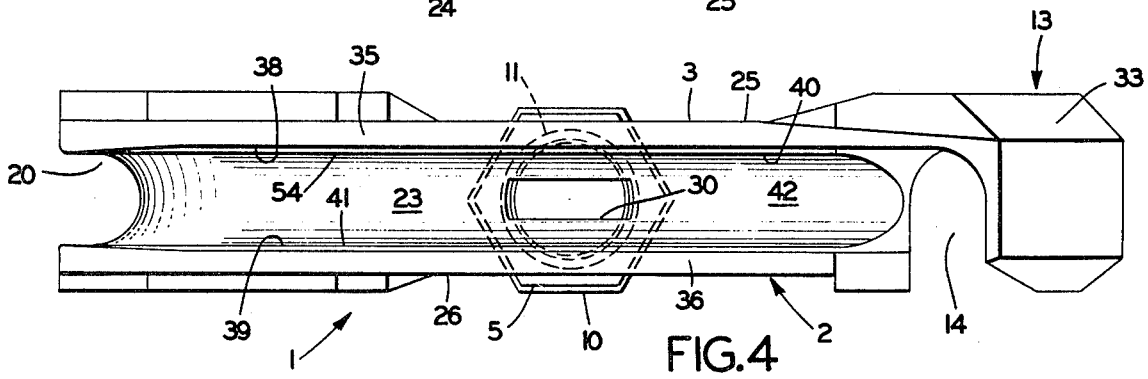
FIG. 4 is a bottom plan view of the bender construction shown in FIG. 2.

Curved base 3 may be provided with a plurality of spaced lineal degree-marking indicia 24, preferably cast into each side of base 3, as shown in FIGS. 1 and 3. These markings are similar to those shown in U.S. Pat. No. 3,063,314 and are used to enable a tradesman or electrician to bend a section of conduit to a predetermined angle less than the usual full 90° bend.

Figure 9:
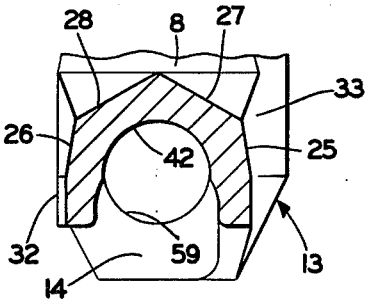
FIG. 9 is an enlarged sectional view taken on line 9—9, FIG. 1.

Curved base 3 is formed by a pair of arcuate-shaped side walls 25 and 26 which are spaced laterally from each other forming the conduit-receiving groove means therebetween, as in prior bender constructions. Side walls 25–26 are shown in elevation in FIGS. 2 and 3 and in cross section in FIGS. 5–10. Walls 25 and 26 are connected by a longitudinally extending, arcuate-shaped wall 23 which at one end of base 3 is a portion of foot treadle 17 (FIGS. 5 and 6) and at the intermediate area of base 3 is formed by a pair of upwardly projecting converging surfaces 27 and 28 (FIGS. 7 and 9) and by the bottom wall 29 of socket 5. Socket wall 29 may have a longitudinally extending slot 30 formed therein. Wall 26 terminates at the hook end of base 3 in a reinforcing rib 32 (FIG. 1) which merges with upright member 8 and is adjacent sloped side opening 14. Wall 25 merges with a thickened wall 33 (FIGS. 9 and 10) which forms a part of hook formation 13.

Walls 25 and 26 terminate in edges 35 and 36, respectively, which lie in a common horizontal plane when viewed in cross section, as shown in FIGS. 5–9. Edges 35 and 36 are parallel to each other and having longitudinally extending, arcuate-shaped configurations and form the rocking surfaces on which base 3 is rocked when bending a section of conduit on a flat horizontal surface, such as the ground or a work platform.

The above description describes the general features and construction of a usual type of conduit bender presently used in the conduit bending art. The modifications, which are described in detail below, are improvements on these prior types of benders and provide the desired advantageous results.

In accordance with the invention, a pair of longitudinally extending conduit-receiving grooves 38 and 39 are formed by a plurality of surface sections formed on the inside surfaces of side walls 25 and 26. Groove 38 is referred to as the inner or bottom groove with groove 39 being referred to as the outer or top groove throughout the specification and claims.

Inner groove 38 is formed by a pair of spaced concavely curved surfaces 40 and 41 which merge with a concavely curved surface 42 of connecting wall 23 at the bottom of groove 38. Surfaces 40–42 provide a generally U-shaped cross-sectional configuration, as shown in FIGS. 5–9, forming a semicircle, the center of which is indicated at point 44 (FIG. 5) with a radius R1.

Outer groove 39 is formed by a pair of concave surfaces 45 and 46 on the outer portions of walls 25 and 26 adjacent the conduit-receiving opening. Surfaces 45 and 46 are arcs of an imaginary circle, the center of which is indicated by numeral 48 (FIG. 5) with a radius R2. Surfaces 45 and 46 have arcuate lengths of approximately 33° (FIG. 7) throughout most of their longitudinal lengths.

Figure 5:
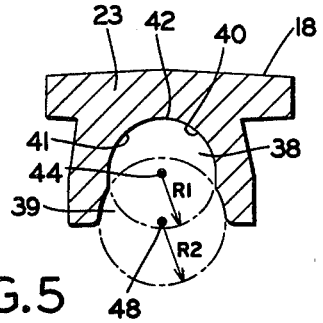
FIG. 5 is an enlarged sectional view taken on line 5—5, FIG. 1.
Figure 6:
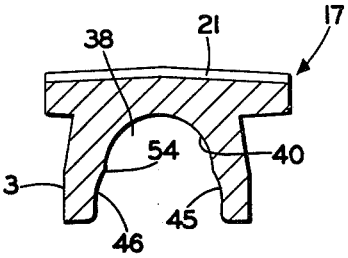
FIG. 6 is an enlarged sectional view taken on line 6—6, FIG. 1.
Figure 7:
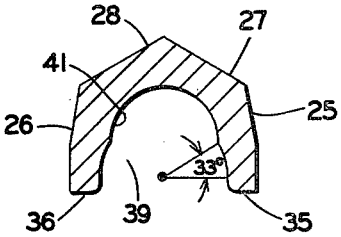
FIG. 7 is an enlarged sectional view taken on line 7—7, FIG. 1.
Figure 8:
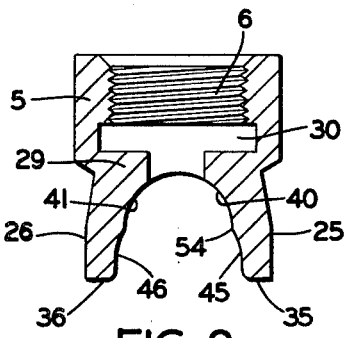
FIG. 8 is an enlarged sectional view taken on line 8—8, FIG. 1.
Figure 13:
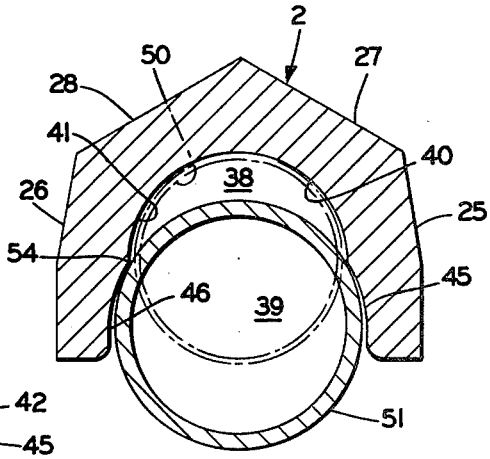
FIG. 13 is a further enlarged sectional view, similar to FIG. 7, showing both a thin-wall and heavy-wall conduit being located within their respective groove formed therein.

FIG. 13 is an enlarged cross-sectional view similar to FIG. 7 illustrating the positions that the various conduits will assume in grooves 38 and 39 during a bending operation. A thin-wall conduit 50 will lie within inner groove 38 and will be in contact with the inner groove arcuate bending surface formed by contiguous inner side wall surfaces 40–41 and bottom surface 42. This U-shaped or semicircular groove configuration and the bending of a conduit therein is the same as in a usual tube bender having a singular conduit-receiving groove. A heavy-wall conduit 51, which may be any one of the three types previously described, namely, IMC-types 1 and 2 and Rigid, will lie within the imaginary circle of outer groove 39, which has a radius R2, as shown in FIG. 5. Conduit 51 will be in bending contact with arcuate surfaces 45 and 46 which are arcs of the imaginary outer circle. The contacting surface lengths of approximately 33° for surfaces 45 and 46 provide sufficient supporting surface area for the bending of heavy-wall conduits, wherein a greater supporting area is required for thin-wall conduits, such as the approximately 180° arcuate surface provided by inner groove 39.

Figure 11:
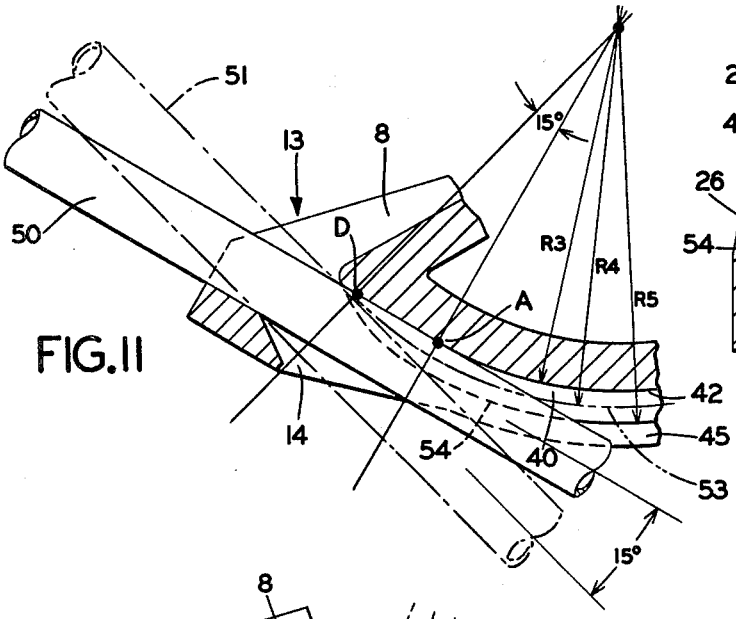
FIG. 11 is a fragmentary diagrammatic view showing a section of thin and heavy-wall conduits at the start of the bending operation.
Figure 12:
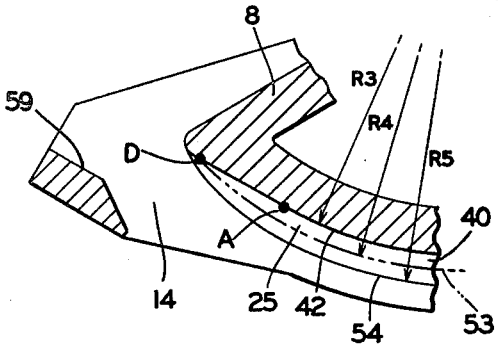
FIG. 12 is a view similar to FIG. 11 showing the curvature of the outer groove-forming surfaces at the hook end of the bender.

Another feature of the invention is the offsetting of the longitudinally extending arcuate bending surfaces of grooves 38 and 39 with respect to hook end 13 of the bender, shown diagrammatically in FIGS. 11–12 and in FIGS. 1 and 3. Grooves 38 and 39 preferably have arcuate bending surfaces of approximately 100° for use in marking the usual 90° bends. This additional 10° provides sufficient over-bending to the conduit to compensate for the natural "spring back" of the metal which will occur after removal of the conduit from the bender. FIG. 1 shows the location of the 100° bending arc for the thin-wall conduit-forming groove 38 which extends between points A and B. FIG. 3 shows the 100° bending arc for the heavy-wall conduit bending groove 39 extending between points C and D. Conduits 50 and 51 are bent by bender 1 in the usual manner, as in the single groove benders, in that the conduit is inserted through sloped side opening 14 of hook end 13 and is bent along the arcuate bending surfaces by the application of a bending pressure to a bending handle (not shown) engaged in socket 5 and supporting sleeve 10 and to foot treadle 17.

The conduit-engaging bending surface of inner groove 38 is defined by contiguous surfaces 40, 41 and 42 and has an innermost radius indicated by R3 (FIGS. 1, 3, 11 and 12). The innermost radius of outer groove 39 is shown by an imaginary dot-double-dash line 53 having a radius indicated by R4. The bottom of the actual contact surfaces 45 and 46 are shown by line 54 having a radius R5. Line 54 is the junction of lower groove-forming surfaces 40 and 41 with upper groove-forming surfaces 45 and 46.

Figure 14:
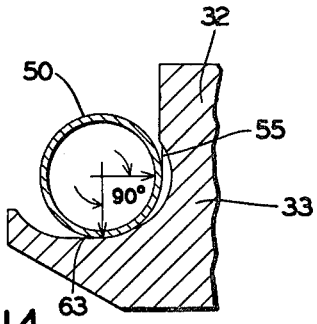
FIG. 14 is an enlarged sectional view taken on line 14—14, FIG. 1, with a heavy-wall conduit being shown in section.

Referring particularly to FIGS. 11 and 12, thin-wall conduit 50, which is shown in full lines, will begin bending at point A and continues bending along bottom surface 42 of wall 23 and has an inside radius of R3. Heavy-wall conduit 51 will begin bending at point D with the innermost conduit surface following along an imaginary line 53 having a radius of R4. Point D is spaced 15° from point A so that heavy-wall conduits 51 will begin their bending arc approximately 15° before the start of the bending arc for thin-wall conduits 50. This arrangement provides for full arcuate contact of approximately 90° at the start of the bend between the curved groove-defining surface 55 (FIG. 14) and the conduit wall to prevent collapse of the conduit wall. Only the two-point contact of surfaces 45 and 46 would be provided if the bending of heavy-wall conduits 51 started at the same position (point A) as do the thin-wall conduits.

Figure 10:
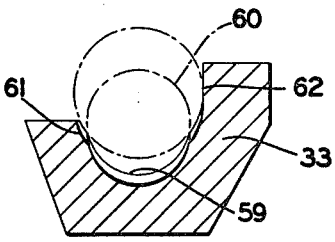
FIG. 10 is an enlarged sectional view taken on line 10—10, FIG. 1.

Another feature of the invention is the particular formation of hook end formation 13 and particularly, the concavely curved, conduit-engaging surface thereof, shown particularly in FIG. 10. This concavely curved inner surface of hook 13 is provided with a semicylindrical bottom surface 59 having a radius of curvature complementary to the outside radius of curvature of a thin-wall conduit 50, which is shown in cross section by imaginary circle 60. Thus, hook surface 59 provides a full contact surface with a thin-wall conduit throughout an arc of approximately 180° to prevent collapse of the conduit during a bending operation.

This inside curved surface of hook 13 also is provided with a short arcuate curved section 61 adjacent the top open end of the hook and a generally diametrically opposite upstanding wall portion 62 (FIG. 10). Surface 61 and wall 62 in combination with a bottom portion of groove-defining surface 55, indicated at 63 (FIG. 14) provides a three-point surface contact of hook 13 with heavy-wall conduit 51. This three-point contact prevents deformation of heavy-wall conduits in the hook area which could occur if only a two-point contact were provided.

The term "point contact" used above means areas of contacting surfaces and not mere tangential points.

Accordingly, the improved conduit bender construction provides a construction which is effective, safe, inexpensive and efficient in assembly, operation and use, and which achieves all of the enumerated objectives, provides for eliminating difficulties encountered with prior bending devices, and solves problems and obtains new results in the art.

In the foregoing description, certain terms have been used for brevity, clearness and understanding, but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details of the construction shown or described.

Having now described the features, discoveries and principles of the invention, the manner in which the improved conduit bender is constructed, assembled and operated, the characteristics of the new construction, and the advantageous, new and useful results obtained; the new and useful structures, devices, elements, arrangements, parts, and combinations are set forth in the appended claims.

I claim:

1. A bender construction including:

(a) a body having a curved base portion, a fixed hooked end formation formed integrally with said base portion at one end thereof and socket means, said socket means being adapted to receive an end of an operating handle;

(b) said base portion having a pair of laterally spaced, longitudinally extending, arcuate-shaped side walls forming a longitudinally extending conduit-receiving opening therebetween;

(c) an end wall integrally connected to and extending between the side walls opposite of said conduit-receiving opening; and (d) the side walls having two pairs of spaced, concavely curved inner surfaces forming inner and outer overlapping longitudinally extending conduit-receiving grooves therebetween, said grooves each having an arcuate bending length of approximately 100° with said grooves being in concurrent relationship with respect to each other for approximately 70° of their individual 100° bending arcs, and with the bending arc of the outer groove starting approximately 15° before the bending arc of the inner groove with respect to the hooked end formation of the curved base portion.

2. The bender construction defined in claim 1 in which the body portion has a treadle formation integrally connected at the other end of said curved base portion from the hooked end formation.

3. The bender construction defined in claim 1 in which one pair of said curved inner surfaces which form the inner groove have a contiguous U-shaped cross-sectional configuration including said end wall.

4. The bender construction defined in claim 1 in which the inner and outer grooves are defined in cross section by imaginary circles which lie in overlapping relationship with respect to each other.

5. The bender construction defined in claim 1 in which the starting point of the outer groove is defined by a contiguous transverse arcuate surface of approximately 90° adjacent the hooked end formation to provide full contact with a heavy-wall conduit throughout this arcuate length.

6. The bender construction defined in claim 1 in which the hooked end formation is formed with concavely curved inner surface means providing full contact surface with a thin-wall conduit throughout a transverse arc of approximately 180°; and in which said surface means provides a three-point contact with a heavy-wall conduit.

7. The bender construction defined in claim 1 in which said pair of curved inner surfaces which form the outer groove is in cross section a pair of laterally spaced, arcuate surfaces forming part of an imaginary circle which defines said outer groove.

8. The bender construction defined in claim 7 in which the arcuate surfaces of the outer groove each have an arcuate length of approximately 33° throughout the major portion of the longitudinally extending outer groove.

* * * * *